US005350091A

United States Patent [19]

Leete et al.

[11] Patent Number: 5,350,091

[45] Date of Patent: Sep. 27, 1994

[54] FUEL POURING NOZZLE

[76] Inventors: Jeremy S. Leete, V8R 6T5; Christopher A. Ring, both of 207 - 3921 Shelbourne Street, Victoria, British Columbia, Canada, V8P 4H9

[21] Appl. No.: 60,004

[22] Filed: May 12, 1993

Related U.S. Application Data

[63] Continuation-in-part of Ser. No. 885,422, May 18, 1992, abandoned.

[51] Int. Cl.[5] ..... B67C 11/04

[52] U.S. Cl. ..... 222/529; 141/337; 222/568

[58] Field of Search ..... 222/544, 527, 529, 531, 222/556, 528, 532, 566, 568, 537; 141/337, 338, 344

[56] References Cited

U.S. PATENT DOCUMENTS

| | | | |
|---|---|---|---|
| 4,595,130 | 6/1986 | Berney | 222/539 |
| 4,832,238 | 5/1989 | Taylor | 222/529 |
| 4,946,079 | 8/1990 | Campbell | 222/484 |
| 5,020,702 | 6/1991 | James | 222/529 |

*Primary Examiner*—Sherman Basinger
*Attorney, Agent, or Firm*—Norman M. Cameron

[57] ABSTRACT

A fuel pouring nozzle for use on vented fuel containers has a base adapted to be attached to a vented fuel container. The base has an end portion at a first end, a downstream end at a second end and a radially extending circumferential ridge situated on the end portion. There is a tubular valve body having a cylindrical side wall with an opening therein, an upstream end having a valve seat and a downstream end having a female threaded portion. A tubular conduit is connected to the upstream end of the valve body and the downstream end of the base. A first O-ring is fitted to the valve seat and faces the downstream end of the valve body. A second O-ring is fitted about the opening in the side wall inside the valve body. A ball valve is positioned in the valve body against both O-rings. The ball valve has a stem extending through the opening in the side wall and is rotatable about a longitudinal axis through the stem. There is handle exterior to the valve body and connected to the stem of the ball valve. A tubular member has an upstream end with a male threaded portion engaging the female threaded portion of the valve body, an accordion-like, snap-lock, segmented portion attached to the male threaded portion and a narrowed, rigid tubular section connected to the segmented portion and forming a spout. There is a closure cap having a protrusion on one side which releasably fits with the base to seal the nozzle and has a slot to releasably engage the handle on the ball valve so the cap acts as a knob to open and close the valve.

7 Claims, 8 Drawing Sheets

FUEL POURING NOZZLE

RELATED APPLICATION

This is a continuation-in-part of U.S. patent application Ser. No. 07/885,422 filed May 18, 1992 and now abandoned.

BACKGROUND OF THE INVENTION

1. Field of the Invention

This invention relates to removable pouring nozzles for fuel cans, in particular to nozzles having integral shut off valves.

2. Description of Related Art

Combustible fuels, such as gasoline as well as other liquids, are frequently spilled when poured from containers or cans. This is particularly prone to happening when spouts without shut off valves are used. The fuels are often spilled when a container is upturned in an attempt to insert the nozzle into an opening before a discharge of fuel begins.

U.S. Pat. No. 4,595,130 to Berney shows a reversible pouring spout assembly for containers. The spout can be reversed and stored inside the container when not in use. There is a cap screwed onto the container to prevent a spillage of liquid when the spout is so stored.

Spouts with accordion-like flexible portions have been developed in an attempt to allow the spout to be bent and accordingly reduce the chance of spillage by aiming the spout more accurately at an opening. An example is found in U.S. Pat. No. 5,020,702 to James. The spout shown in this patent also has an integral valve.

U.S. Pat. No. 4,946,079 to Campbell shows a pouring spout with an integral ball valve having an external handle.

U.S. Pat. No. 4,832,238 to Taylor shows another nozzle with an extendable snap-lock, accordion-like section.

Prior art nozzles of this general type suffer from certain deficiencies. For example, some of them do not incorporate a filter in the spout to protect the valve mechanism and strain the passing fluid of impurities. Some of these spouts are not adapted to be inverted and stored internally. The spout shown in the patent to Campbell is designed for unvented oil containers. The fluid flow passage through the ball valve is greatly reduced because of the addition of an air vent that is also incorporated within this valve.

Another problem associated with prior art nozzles of this type is the storage of caps used for sealing the nozzles when not in use. In some cases they are loose and prone to being lost. In other cases they are attached by strings or flexible tethers such as in a number of the prior art patents discussed above. Often these strings or tethers are broken and again the caps arc subject to loss. Furthermore, some of the prior art patents with valves have small handles which are difficult to turn when the user is wearing gloves, if the valve is sticking or in cold weather.

A need exists for a more efficient and versatile pouring nozzle for gasoline and other fuels as well as other liquids. The prior art pouring spouts do not have the combination of features required to achieve the efficiency, universality, versatility and utility which is required.

SUMMARY OF THE INVENTION

It is an object of the invention to provide an improved fuel pouring nozzle with all the advantages of the prior art and none of the disadvantages associated therewith.

It is another object of the invention to provide an improved nozzle liar a fuel container or the like with reduced risk of losing a closure cap when it is not in use.

It is a further object of the invention to provide an improved nozzle for fuel containers or the like having an effective and easy to operate closure valve integral with the nozzle.

In accordance with these objects, there is provided a fuel pouring nozzle for use on vented containers. The nozzle includes a base adapted to the attached to, a vented fuel container having a threaded neck and a screw cap. The base has an end portion at a first end and a downstream end at a second end. There is a tubular valve body having a cylindrical side wall with an opening therein, an upstream end having a valve seat and a downstream end. A tubular conduit connects the upstream end of the valve body and the downstream end of the base. There is a ball valve positioned in the valve body against the valve seat. The ball valve has a stem extending through the opening in the side wall and is rotatable about a longitudinal axis through the stem between a position which opens the nozzle and a position which closes the nozzle. The ball valve has a passageway therethrough which communicates with the upstream and downstream ends of the valve body when the valve is rotated to an open position. A tubular member has an upstream end connected to the valve body and a downstream end forming a spout. There is a closure cap having an inner side with a protrusion which releasibly fits within the end portion of the base. There is also means for releasibly engaging the ball valve and the closure cap to rotate the ball valve when the closure cap is removed from the base.

DESCRIPTION OF THE PREFERRED EMBODIMENTS

Figure 1:
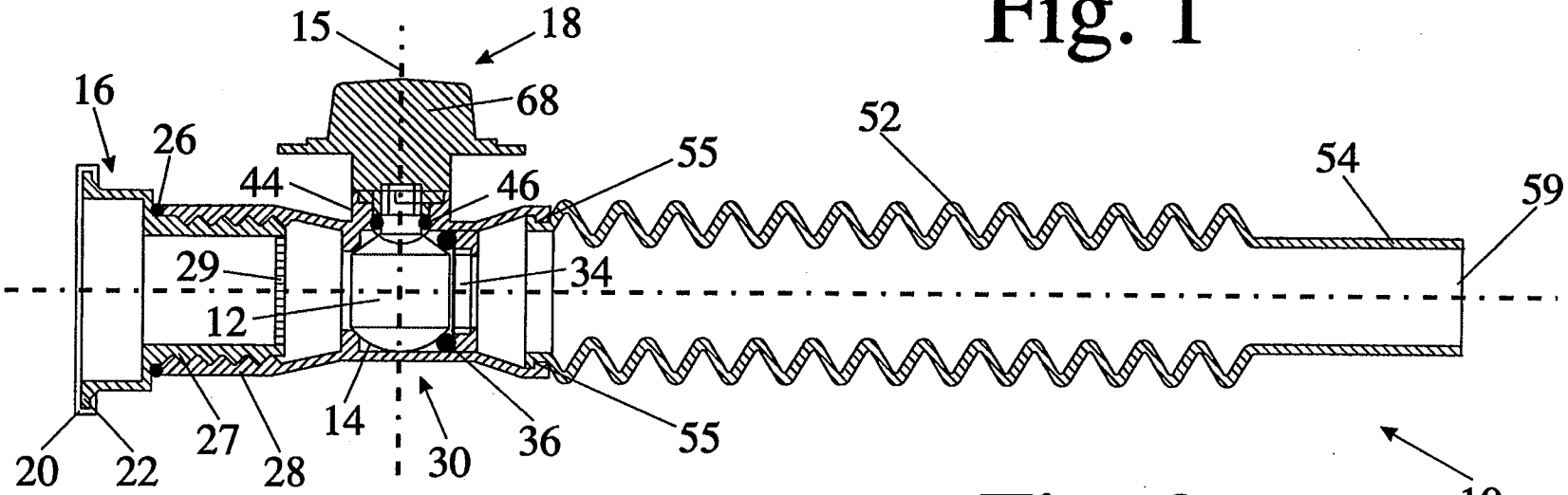
FIG. 1 is a longitudinal section of a fuel pouring nozzle according to a first embodiment of the invention.
Figure 2:
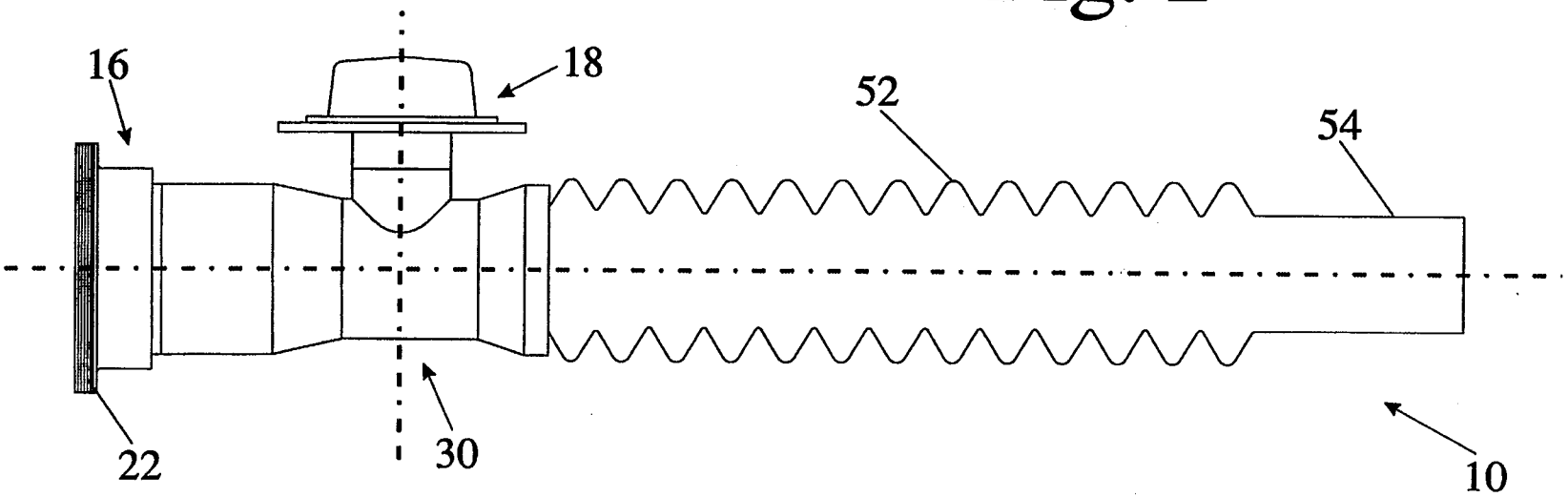
FIG. 2 is a side elevation thereof.
Figure 3:
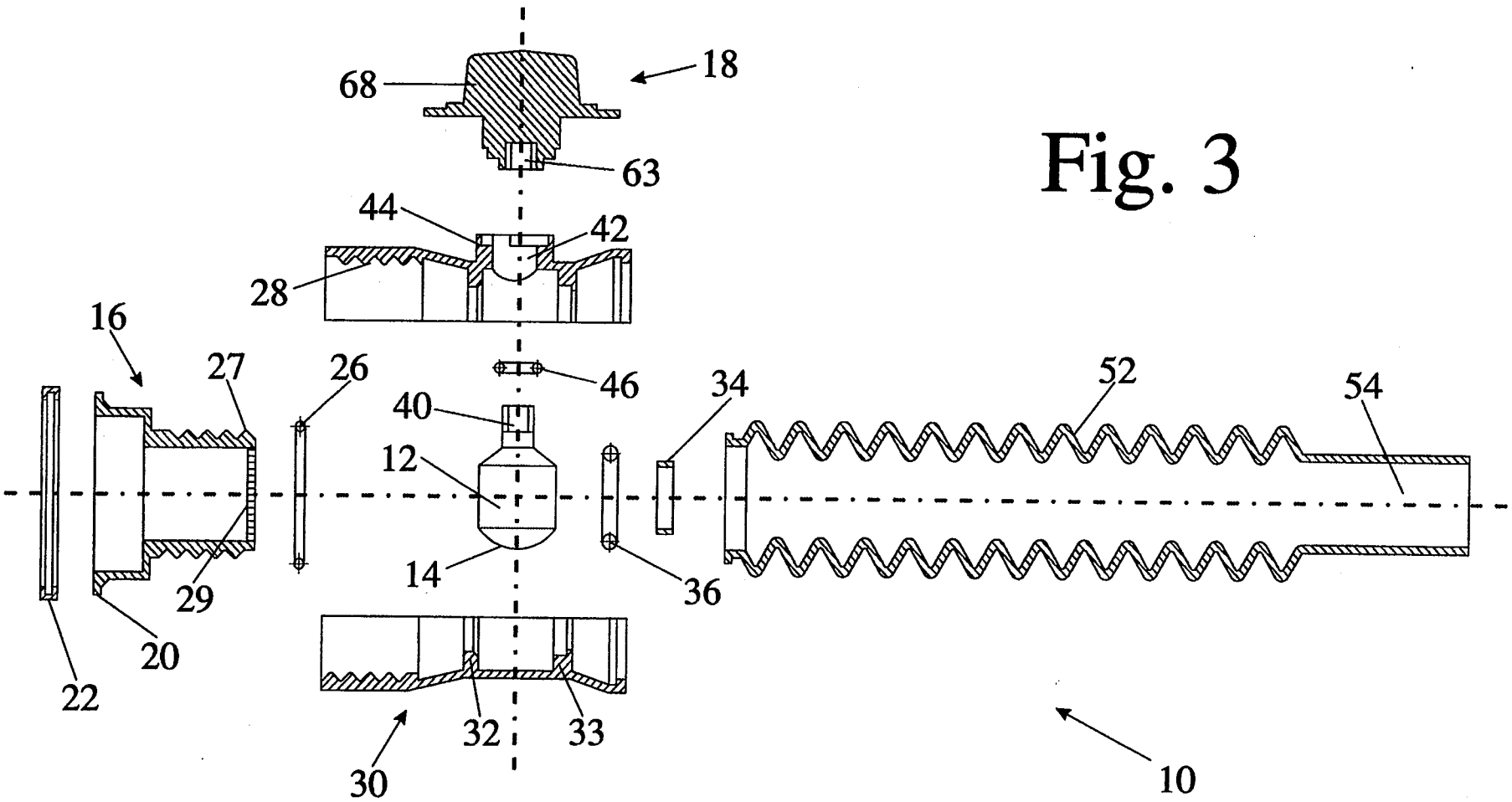
FIG. 3 is an exploded sectional view thereof.
Figure 6:
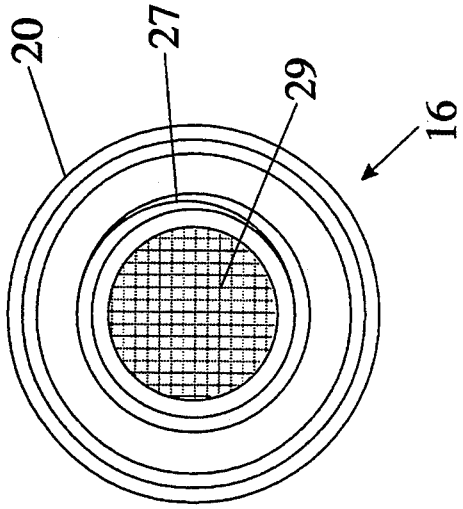
FIG. 6 is an end view showing the end opposite FIG. 4.
Figure 5:
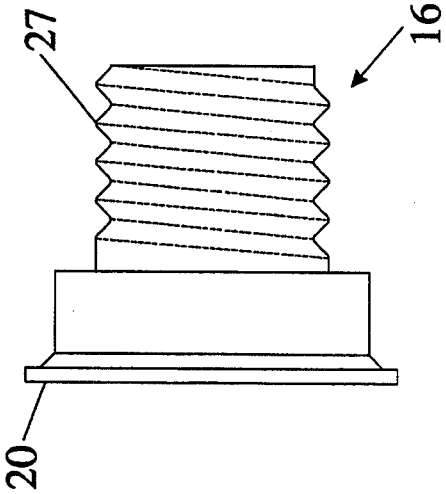
FIG. 5 is a side view of the removable base.
Figure 7:
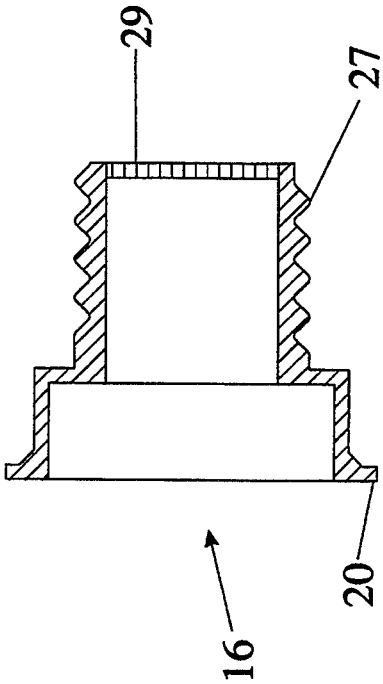
FIG. 7 is a longitudinal section through the base.
Figure 4:
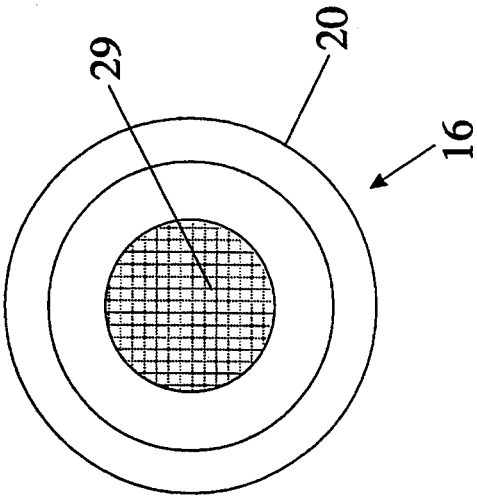
FIG. 4 is an end view of the removable base thereof.

Referring first to the embodiment of FIGS. 1–20, a nozzle for fitting on vented fuel containers and the like is shown generally at 10 in FIGS. 1–3. The nozzle has an integral ball valve 14 having a passageway 12 therethrough which permits a flow of fluid through the nozzle when rotated to the open position shown in FIG. 1. The ball valve may be rotated about axis 15, shown in FIG. 1, to a closed position to prevent a flow of fluid through the nozzle.

Nozzle 10 has a removable base 16 which is shown in better detail in FIGS. 4–7. The base has a flattened, radially outwardly extending flange or circumferential ridge 20 which, in this embodiment, is covered by a resilient circular rubber gasket 22, shown in FIGS. 1 and 2. The nozzle is fitted onto the spout of a fuel container 24, shown in FIGS. 17–19, by an annular, threaded cap 25 which slides over the nozzle and engages the container's threaded neck. This cap may be tile existing screw cap of the container. As the screw cap is tightened, gasket 22 is compressed against the neck of the container, forming a liquid-tight seal.

Referring back to FIGS. 4–7, the base has a threaded male section 27 on its downstream end. The base also has a removable filter 29 positioned internally at the downstream end which serves to strain the passing fluid.

The nozzle includes a generally cylindrical valve body 30, shown in FIGS. 1, 2, 3 and 8–11, which houses the ball valve 14. The valve body has internal spaced-apart annular valve seats 32 and 33. Seat 33 is fitted with O-ring 36. There is also an annular insert 34 to hold the valve in place. In this embodiment the insert is glued to the inside of the valve body.

Figure 8:
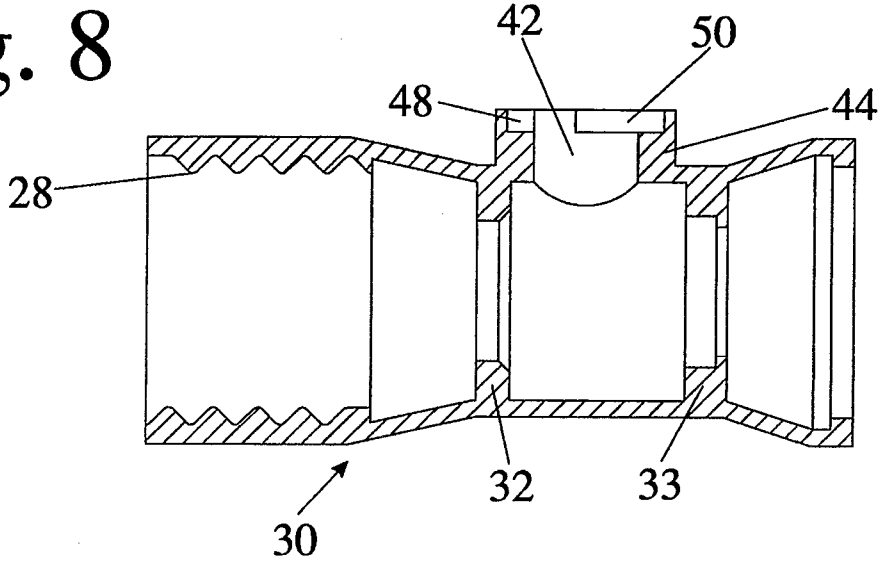
FIG. 8 is a longitudinal section of the valve body of the embodiment of FIG. 1.
Figure 10:
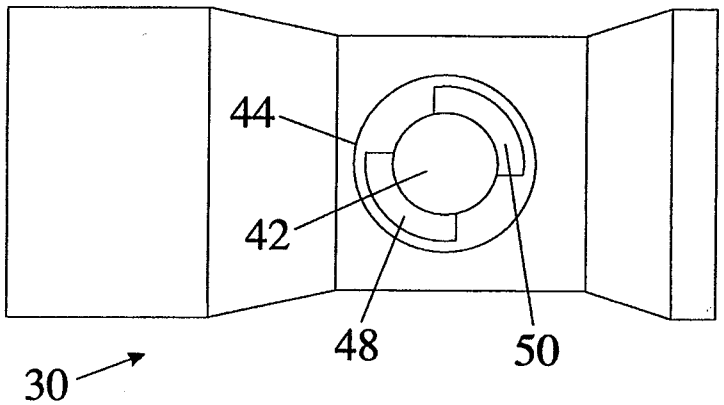
FIG. 10 is a top plan thereof.
Figure 11:
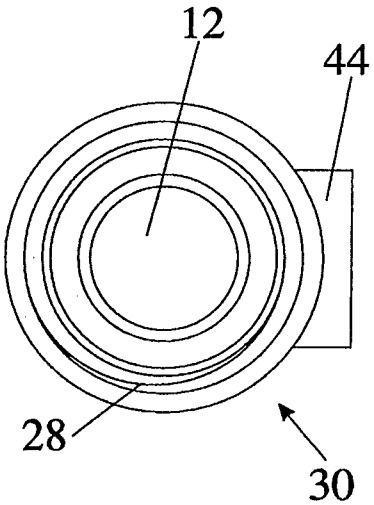
FIG. 11 is an end view showing the end opposite FIG. 9.
Figure 9:
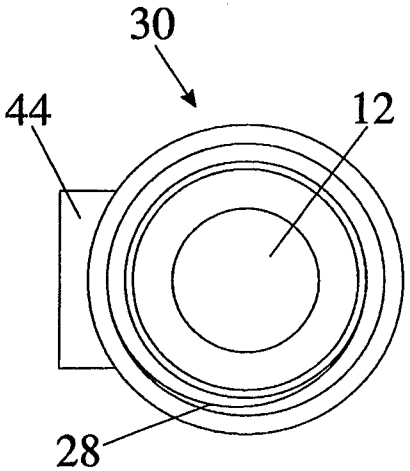
FIG. 9 is an end view thereof.

The ball valve 14 has a valve stein 40, shown in FIGS. 1 and 3, which is generally oblong in shape in this embodiment. The valve stem projects through an opening 42 in valve receptacle 44 provided on the side wall of the valve body as seen in FIGS. 3, 8 and 10. An O-ring 46 fits about the valve stem against the inside of the receptacle 44 to prevent an escape of fluid around the valve stem.

Referring to FIGS. 8 and 10, the opening 42 has two notches 48 and 50 formed therein opposite each other to allow the insertion of closure key 18 as shown in FIGS. 1 and 2. These slots allow the valve to be opened and closed by a quarter turn of 90° only, thus defining the rotation limits of the valve as described in more detail below. The ball valve can be rotated to a partly open position if desired to regulate the flow of fluid. The position of the closure cap 18, and in particular handle 68 thereof, allows the user to judge how much the valve is open.

Figure 17:
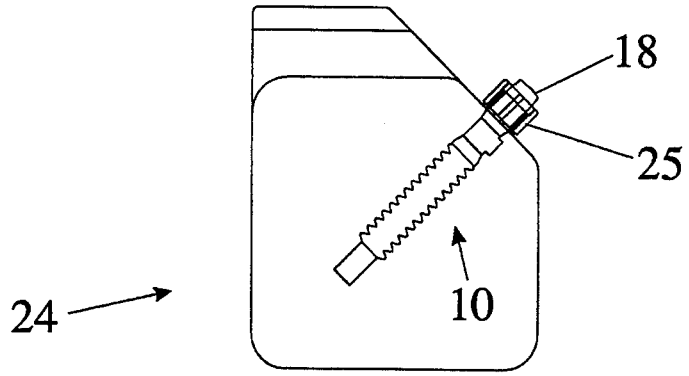
FIG. 17 is a side elevation of a fuel can with the nozzle fitted thereon and stored internally within the container.
Figure 18:
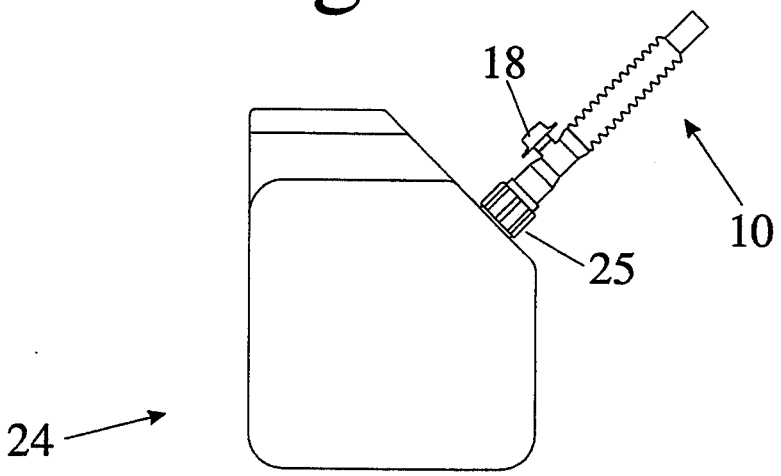
FIG. 18 is a side elevation of the container of FIG. 17 with the nozzle extended and the closure key cap on the valve.

The closure key cap 18 is shown in more detail in FIGS. 12–16. It is preferably constructed of a rigid, molded plastic. As shown in FIG. 17, the cap 18 may be used as a leak-proof closure cap when the nozzle 10 is inverted and stored within the fuel container 24. FIG. 18 shows the cap used as a key for opening and closing the ball valve 14. Handle 68 acts as a finger grip for rotating the valve.

The underside of the key cap 18 has two protrusions 60 and 62. Protrusion 62 is within protrusion 60 and extends outwardly therefrom. It has a hollowed out interior 63 shaped to receive the oblong valve stem 40 described above. There are two tabs 64 and 66 which extend from opposite sides of protrusion 62 and which slide along the notches 48 and 50 when the ball valve 14 is rotated. These limit and define the rotation of the key cap as described below.

The nozzle also includes an accordion-like, snap-lock, segmented portion 52 shown best in FIGS. 1–3. This may be extended or shortened and bent in a number of different configurations according to pouring requirements. The snap-lock portion 52 has a snap-type coupling 53 which engages annular shoulder 55 on the downstream end of the valve body. The portion 52 has a narrowed tubular tip section 54 which acts as a pouring spout.

The opposite side of the valve has female threads 28 which engage threads 27 on the base described above. An O-ring 26 is positioned between the valve body and the base to ensure fluid tightness.

Figure 15:
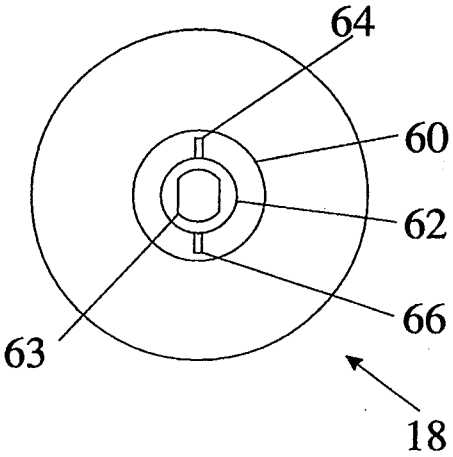
FIG. 15 is a bottom plan view thereof.
Figure 16:
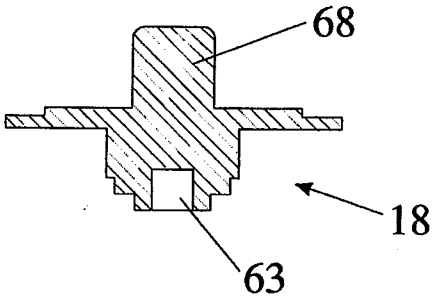
FIG. 16 is an end sectional view thereof.
Figure 14:
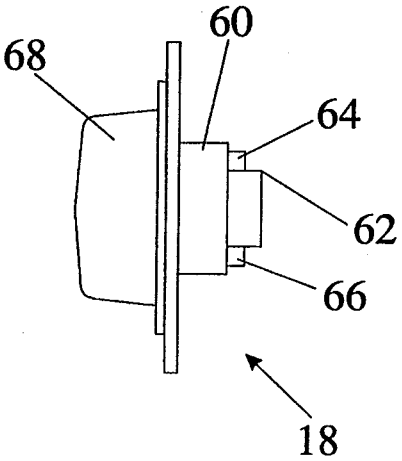
FIG. 14 is a side view of the closure key cap.
Figure 12:
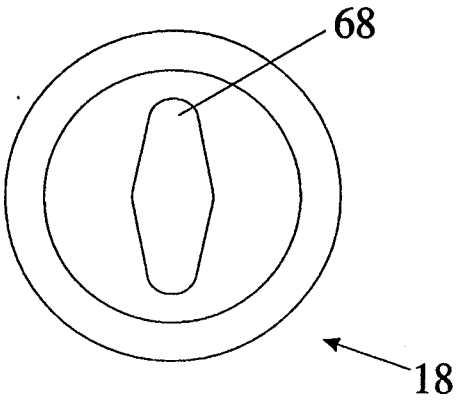
FIG. 12 is a top view of the removable closure key cap thereof.
Figure 13:
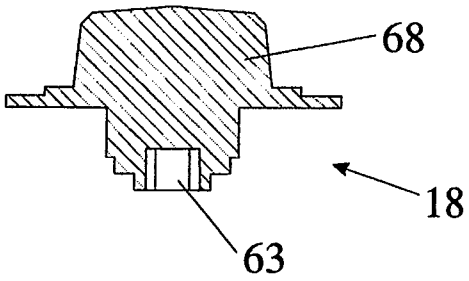
FIG. 13 is a side sectional view of the key cap.
Figure 19:
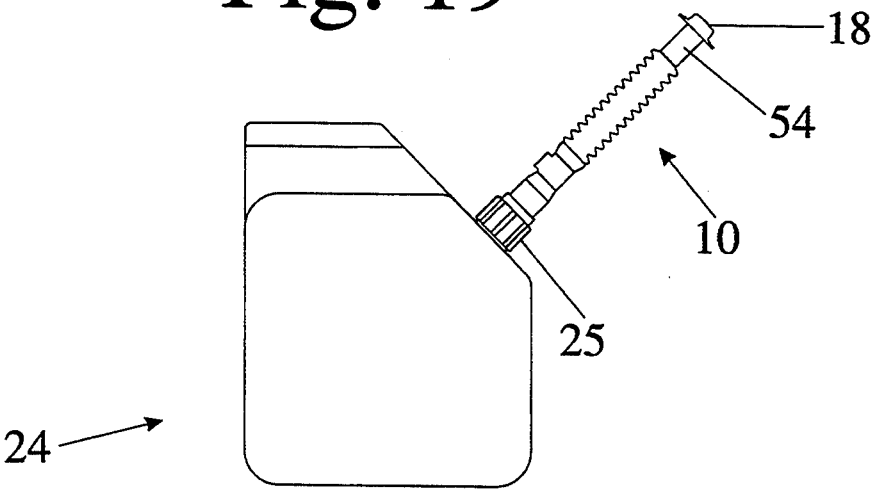
FIG. 19 is a view similar to FIG. 18 with the closure key cap fitted on the end of the nozzle.

The protrusion 60 on the closure key cap, as shown in FIGS. 14 and 15, is adapted to fit within open end 59 on tubular tip section 54 as shown in FIGS. 19 to serve as a grit cover for the spout.

Figure 20:
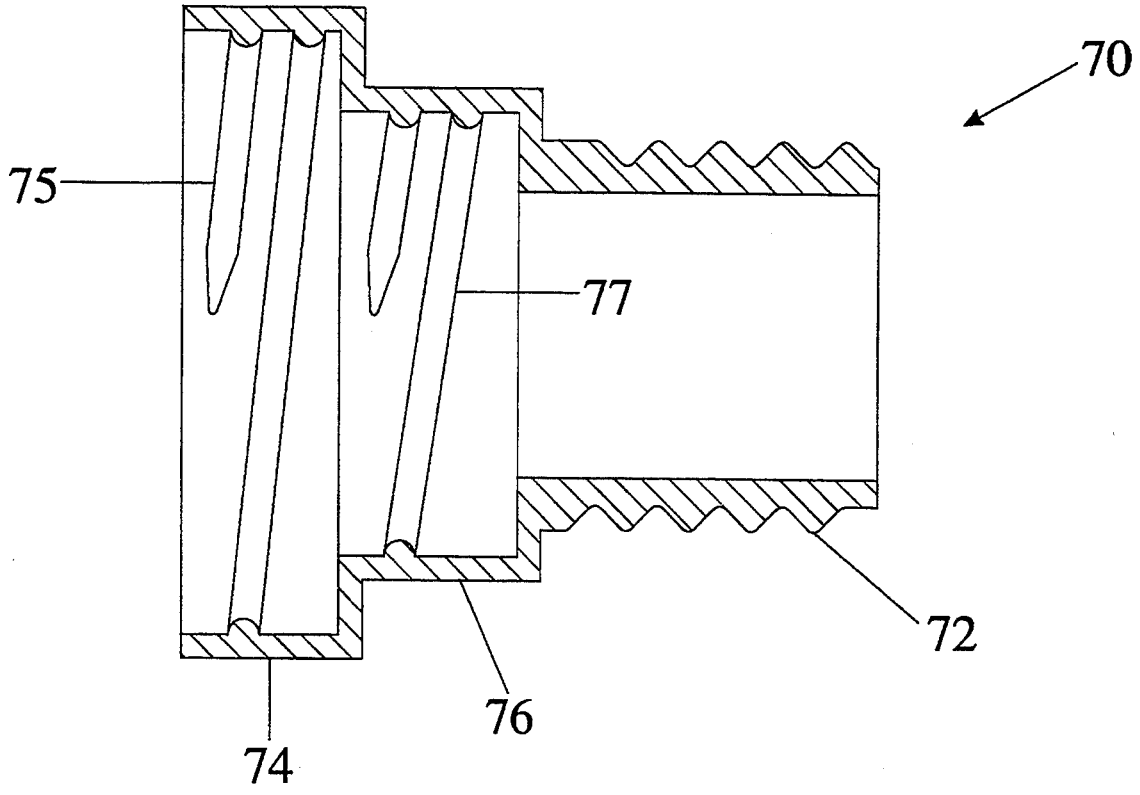
FIG. 20 is a longitudinal section of an adaptor attachment for the base of the embodiment of FIG. 1.

FIG. 20 shows a base attachment 70. It has male threads 72 on its downstream end which are adapted to cooperate with female threads 28 on the valve body. The upstream end of the attachment 70 has two sections 74 and 76, each of which have female threads 75 and 77. This member can be used in place of base 16 to fit different sized containers.

Figure 21:
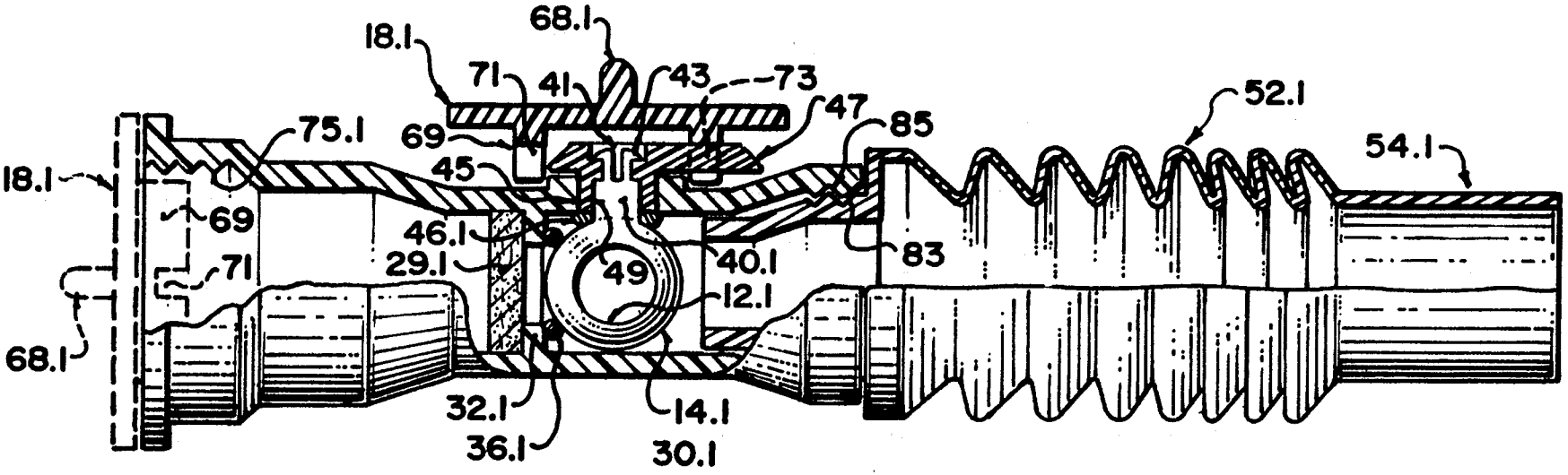
FIG. 21 is a side elevation of a nozzle according to a second embodiment of the invention with the top half thereof being shown in section, the closure cap being shown in stippled lines on the base and being shown in section fitted as a knob on the ball valve thereof.

An alternative nozzle 10.1 is shown in FIG. 21. This embodiment is generally similar to the one just described and therefor reference is made only to the differences there between. Equivalent parts have equivalent numbers with the addition of ".1". In this embodiment, however, valve body 30.1 and base 16.1 are formed by a single annular member. Therefore the base is non-removable and has internal threads 75.1 configured to fit, for example, standard one quart or one liter oil containers as well as other compatible containers. Additional base attachments could be designed to accept the female threads of the base as in the previous embodiment.

Filter 29.1 is designed to be inserted in the base past the threads 75.1 and fits Snugly in place.

In this instance, there is but a single valve seat 32.1 fitted with an O-ring 36.1. The ball valve 14.1 is located within the valve body and presses against the O-ring 26.1 as well as O-ring 46.1 around stem 40.1.

In this instance the valve stem has a split outer portion 41, each side thereof having an outwardly extending protrusion 43. Portion 41 extends through aperture 45 on a handle 47. The protrusions are on the side of the handle opposite to the ball valve 14.1 and therefore hold the handle in place. The handle has an oblong opening 49 which engages the oblong stem 40.1. Thus the handle 47 can be used to rotate the ball valve 14.1 to the open position or the closed position shown in FIG. 21. In an alternative embodiment the handle and valve may be one piece.

Figure 22:
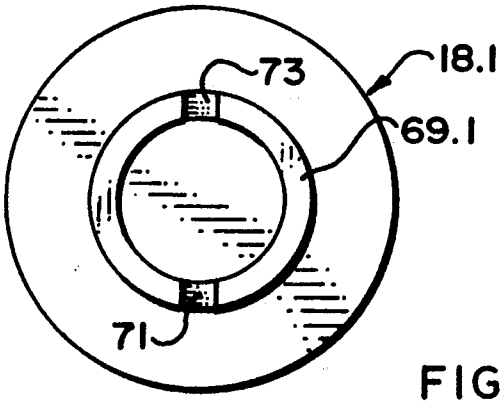
FIG. 22 is a bottom plan of the closure cap of FIG. 21, showing the protrusion and slot thereon.

In this example, closure key cap 18.1 has a single, annular protrusion 69.1 having a pair of slots 71 and 73 on opposite sides thereof as shown in FIG. 22. The slots and protrusion act as a coupling to releasably engage the handle 47 so that the cap can be fitted over the handle to serve as a knob for turning the valve as shown in full lines in FIG. 21. On the other hand, the cap can be fitted on the base as shown in broken lines with the protrusion 69 fitting within the opening in the base to serve as a closure cap. This particular closure key cap is not designed to fit the spout 54.1 of nozzle 10.1 although such an adaptation is possible.

In addition, the embodiment of FIGS. 21 and 22 has a snap-lock portion 52.1 with a male threaded portion 83 which engages with female-threaded portion 85 on the downstream section of the valve body 30.1.

It will be understood by someone skilled in the art that many of the details provided above are by way of example only and can be altered or deleted without departing from the scope of the invention which is to be interpreted with reference to the following claims.

What is claimed is:

1. A fuel pouring nozzle for use on vented fuel containers, comprising:

a base adapted to be attached to a vented fuel container having a threaded neck and a screw cap, said base having an end portion at a first end and a downstream end at a second end;

a tubular valve body having a cylindrical side wall with an opening therein, an upstream end having a valve seat and a downstream end;

a tubular conduit connecting the upstream end of the valve body and the downstream end of the base;

a ball valve positioned in the valve body against the valve seat, said ball valve having a stem extending through the opening in the side wall and being rotatable about a longitudinal axis through the stem between a position which opens said nozzle and a position which closes said nozzle, the ball valve having a passageway therethrough which communicates with the upstream and downstream ends of the valve body when the valve is rotated to an open position;

a tubular member having an upstream end connected to the valve body, and a downstream end forming a spout;

a closure cap having an inner side with a protrusion which releasably fits within the end portion of the base; and means for releasably engaging the ball valve and the closure cap to rotate the ball valve when the closure cap is removed from said base.

2. A nozzle as claimed in claim 1, wherein the means for releasably engaging includes a slot in the protrusion.

3. A nozzle is claimed in claim 2, wherein the stem has a handle thereon external to the valve body, the slot releasably engaging the handle.

4. A nozzle as claimed in claim 3, wherein the closure cap has an outer side with a finger grip thereon.

5. A nozzle as claimed in claim 1, wherein the means includes a member on the stem of the ball valve and a coupling on the protrusion of the closure cap adapted to releasably engage said member.

6. A fuel pouring nozzle for use on vented fuel containers, comprising:

a base adapted to be attached to a vented fuel container having a threaded neck and a screw cap, said base having an end portion at a first end, a downstream end at a second end and a radially extending circumferential ridge situated on the end portion of said base;

a tubular valve body having a cylindrical side wall with an opening therein, an upstream end having a valve seat and a downstream end having a female threaded portion;

a tubular conduit connecting the upstream end of the valve body and the downstream end of the base;

a filter within said tubular conduit;

a first O-ring fitted to the valve seat and facing the downstream end of the valve body;

a second O-ring fitted about the opening in the side wall inside the valve body;

a ball valve positioned in the valve body against both said O-rings, said ball valve having a stem extending through the second O-ring and the opening in the side wall and being rotatable about a longitudinal axis through said stem between a position which opens said nozzle and a position which closes said nozzle, the ball valve having a passageway therethrough which communicates with the upstream and downstream ends of the valve body when the valve is rotated to an open position;

a handle exterior to the valve body and connected to the stem of the ball valve;

a tubular member having an upstream end with a male threaded portion engaging the female threaded portion of the valve body, an accordion-like, snap-lock, segmented portion attached to the male threaded portion, and a narrowed, rigid tubular section connected to the segmented portion and forming a spout, said spout having a free end with an opening; and a closure cap having an outer side with a finger grip and an inner side with a protrusion which releasably fits within the end portion of the base to seal the nozzle, and a slot therein to releasably engage the handle on the ball valve, whereby the finger grip can be used to open and close the ball valve.

7. A fuel pouring nozzle for use on vented fuel containers comprising:

a removable base adapted to be attached to a vented fuel container having a threaded neck and a screw cap, said base having an end portion at a first end and a downstream end at a second end;

a set of male threads positioned on the downstream end of said removable base;

a radially extending circumferential ridge situated on the end portion of said base;

a circular rubber gasket surrounding said ridge and providing a universal seal when said base is attached to said threaded neck of said fuel container;

a filter incorporated within said removable base;

a female threaded portion cooperating with the male threads on said removable base;

a valve scat integral with said female threaded portion;

a ball valve positioned in the valve seat, said ball valve being designed to accept a removable key, and said ball valve being mounted for rotation within said valve seat and being rotatable between a position which opens said nozzle and a position which closes said nozzle;

a three-fold multi-functional removable closure key cap, said cap having a protrusion, first and second tabs extending from said protrusion, said protrusion and said first and second tabs forming said removable key;

an accordion-like snarl-lock, segmented portion, attached to said valve seat;

a narrowed rigid tubular section integral with said segmented portion and forming a spout, said spout having a free end with an opening of a first diameter:

said three-fold multi-functional removable closure key cap protrusion having a diameter such that said protrusion will fit within said first diameter of said opening of said spout free end so as to form a grit cover; and said three-fold multi-functional removable closure key cap being receivable adjacent said end portion of said removable base so as to form a closure cap for said nozzle when said nozzle is stored internally within said fuel container.

* * * * *